US008099961B2

(12) United States Patent
Gerendas

(10) Patent No.: US 8,099,961 B2
(45) Date of Patent: Jan. 24, 2012

(54) GAS-TURBINE COMBUSTION CHAMBER WALL

(75) Inventor: Miklos Gerendas, Am Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 610 days.

(21) Appl. No.: 12/081,573

(22) Filed: Apr. 17, 2008

(65) Prior Publication Data

US 2008/0264065 A1 Oct. 30, 2008

(30) Foreign Application Priority Data

Apr. 17, 2007 (DE) ..... 10 2007 018 061

(51) Int. Cl.
*F02C 1/00* (2006.01)
*F02G 3/00* (2006.01)

(52) U.S. Cl. ..... 60/752; 60/754; 60/755; 60/756; 60/757; 60/759

(58) Field of Classification Search ..... 60/752–760
See application file for complete search history.

(56) References Cited

U.S. PATENT DOCUMENTS

| | | | | |
|---|---|---|---|---|
| 4,607,487 | A | 8/1986 | Tilston | |
| 5,598,697 | A | 2/1997 | Ambrogi et al. | |
| 6,298,667 | B1 * | 10/2001 | Glynn et al. | 60/737 |
| 6,408,628 | B1 | 6/2002 | Pidcock et al. | |
| 7,146,815 | B2 * | 12/2006 | Burd | 60/752 |
| 2003/0101731 | A1 | 6/2003 | Burd et al. | |
| 2003/0140632 | A1 * | 7/2003 | Dailey et al. | 60/752 |
| 2006/0168965 | A1 | 8/2006 | Green et al. | |

FOREIGN PATENT DOCUMENTS

| | | |
|---|---|---|
| DE | 10150259 | 4/2003 |
| DE | 10159056 | 6/2003 |
| EP | 1318353 | 6/2003 |
| EP | 1486730 | 12/2004 |
| GB | 2087065 | 5/1982 |
| GB | 2360086 | 9/2001 |
| WO | 92/16798 | 10/1992 |
| WO | 9525932 | 9/1995 |

OTHER PUBLICATIONS

German Search Report dated Sep. 17, 2008 from corresponding foreign application.
European Search Report dated Mar. 28, 2011 for counterpart European patent application.

* cited by examiner

*Primary Examiner* — Ehud Gartenberg
*Assistant Examiner* — Craig Kim
(74) *Attorney, Agent, or Firm* — Timothy J. Klima; Shuttleworth & Ingersoll, PLC

(57) ABSTRACT

A gas-turbine combustion chamber wall for a gas-turbine has a combustion chamber wall 9, on the inner side of which several tiles 10 are arranged, with an interspace 14 being formed between the tiles 10 and the combustion chamber wall 9, into which cooling air is introduced via impingement-cooling holes 8 provided in the combustion chamber wall 9 and from which the cooling air flows into the combustion chamber via effusion-cooling holes 11, 23 provided in the tile 10. The tile 10 includes a surface structure 19, 22 on the side facing the combustion chamber wall 9. The area of the impingement-cooling holes 8 and the area of the effusion-cooling holes 11 do not coincide.

17 Claims, 3 Drawing Sheets

Figure 3:
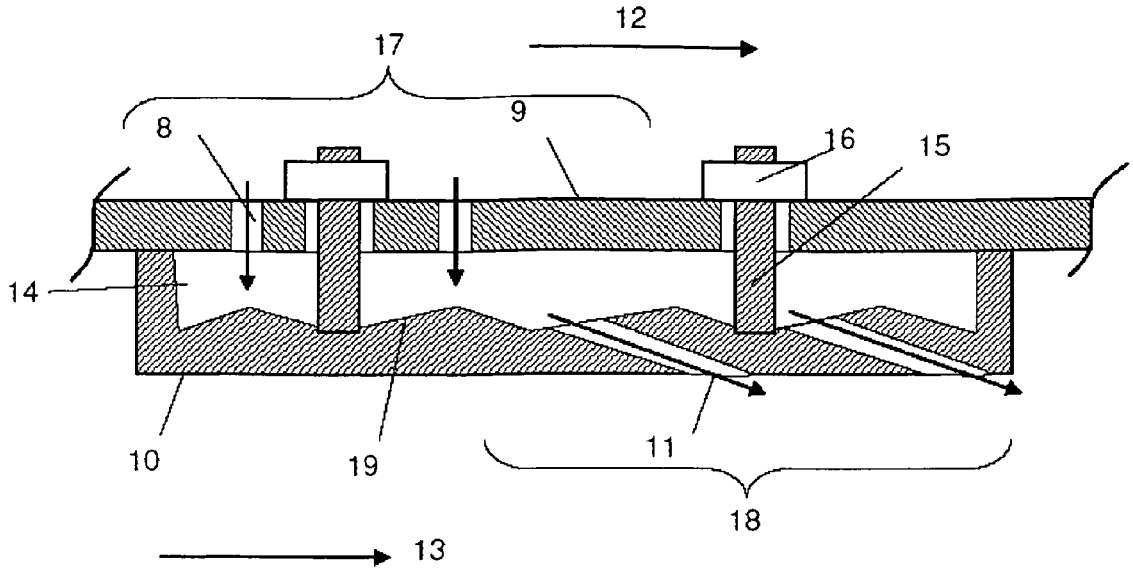

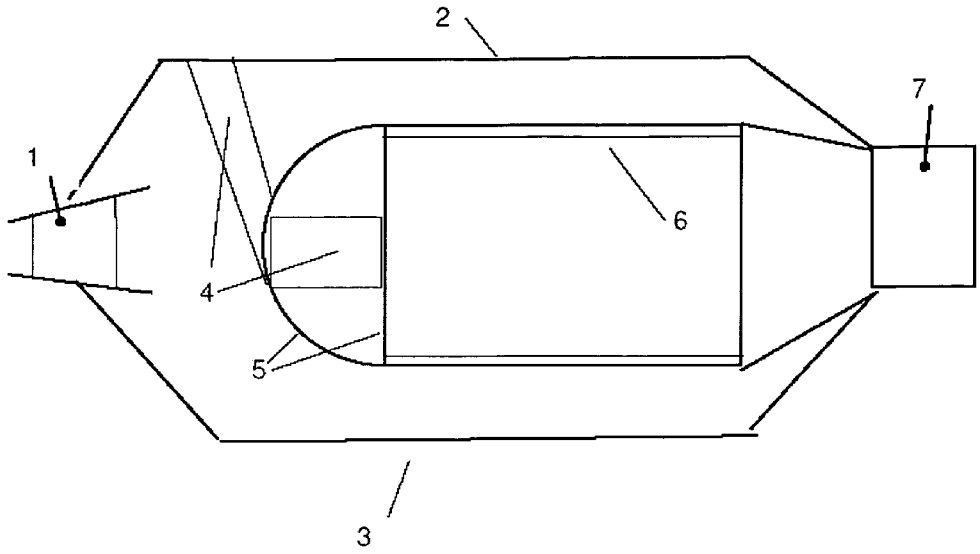
(Prior Art) Fig. 1
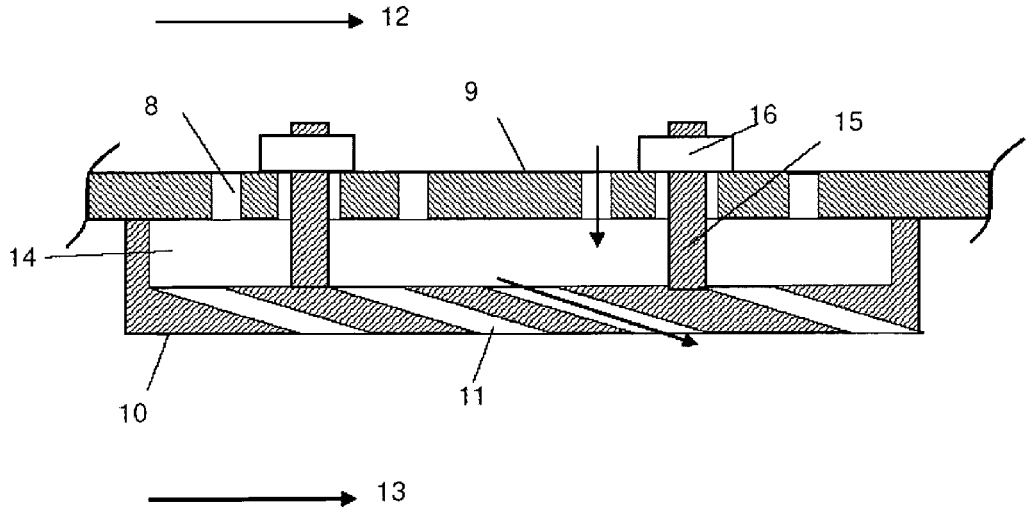
(Prior Art) Fig. 2

GAS-TURBINE COMBUSTION CHAMBER WALL

This application claims priority to German Patent Application DE102007018061.8 filed Apr. 17, 2007, the entirety of which is incorporated by reference herein.

This invention relates to a gas-turbine combustion chamber wall.

Specifications GB 9 106 085 A and WO 92/16798 A describe the design of a gas-turbine combustion chamber with metallic tiles attached by studs which, by combination of impingement and effusion, provides an effective form of cooling, enabling the consumption of cooling air to be reduced. However, the pressure loss, which exists over the wall, is distributed to two throttling points, namely the tile carrier and the tile itself. In order to avoid peripheral leakage, the major part of the pressure loss is mostly produced via the tile carrier, reducing the tendency of the cooling air to flow past the effusion tile.

Specification GB 2 087 065 A describes an impingement-cooling configuration with a pinned or ribbed tile, with each individual impingement-cooling jet being protected against the transverse flow by an upstream pin or rib provided on the tile. Furthermore, the pins or ribs increase the surface area available for heat transfer.

Specification GB 2 360 086 A describes an impingement-cooling configuration with hexagonal ribs and prisms being partly additionally arranged centrally within the hexagonal ribs to improve heat transfer.

Specification GB 9 106 085 A uses only a plane surface as target of impingement cooling. A provision of ribs would, except for simply increasing the surface area, have little use as the ribs, which are shown, for example, in Specification GB 2 360 086 A, require overflow to be effective. However, due to the coincidence of the impingement-cooling air supply and the air discharge via the effusion holes, no significant velocity is obtained in the overflow of the ribs. The pressure difference over the tile is partly reduced by the burner swirl to such an extent that the effusion holes are no longer effectively flown or, even worse, hot-gas ingress into the impingement-cooling chamber of the tile may occur.

Film cooling is the most effective form of reducing the wall temperature since the insulating cooling film protects the component against the transfer of heat from the hot gas, instead of subsequently removing introduced heat by other methods. Specifications GB 2 087 065 A and GB 2 360 086 A provide no technical teaching on the renewal of the cooling film on the hot gas side within the extension of the tile. The tile must in each case be short enough in the direction of flow that the cooling film produced by the upstream tile bears over of the entire length of the tile. This invariably requires a plurality of tiles to be provided along the combustion chamber wall and prohibits the use of a single tile to cover the entire distance.

In Specification GB 2 087 065 A, the airflow in the form of a laminar flow passes a continuous, straight duct, providing, despite the complexity involved, for quick growth of the boundary layer and rapid reduction of heat transfer.

Specification GB 2 360 086 A does not provide a technical teaching as regards the discharge of the air consumed. Therefore, also this arrangement is only suitable for small tiles. With larger tiles, the transverse flow would become too strong, and the deflection of the impingement-cooling jet would impede the impingement-cooling effect.

The present invention, in a broad aspect, provides for a gas-turbine combustion chamber wall of the type specified above, which features high cooling efficiency and good damping behavior, while being characterized by simple design and easy, cost-effective producibility.

The present invention accordingly provides for impingement-effusion cooled tiles provided with a surface structure, e.g. in the form of hexagonal ribs or other polygonal shapes, with the discharge of the air consumed from the impingement-cooling gap via effusion holes being arranged such that the impingement-cooling hole array for air supply and the effusion hole field for air discharge are not coincidental. The area provided with a surface structure may cover the entire tile, or only an optimised portion in which a significant overflow of the surface structure takes place, thereby providing for an increase in noticeable heat transfer. The shift may be provided in circumferential direction or in axial direction, or in any combination thereof.

The hexagonal ribs may be filled with a prism such that the tip of the prism is at, beyond or below the level of the ribs, respectively. The surface structure may be formed by triangular, quadrangular or other polygonal cells. The surface structure may also comprise circular or drop-like depressions, with the axial and/or circumferential shift between impingement-hole array, surface-structured area and effusion-hole array being decisive here as well. If impingement-cooling holes are provided in the area of the surface structure, the impingement-cooling jets hit the tile essentially in the middle of the polygonal cells, or at the lowest point of the circular or drop-like depressions, respectively.

On the side facing the hot gas, the tile may be provided with a thermal barrier coating of ceramic material.

The impingement-cooling holes are axially and/or circumferentially variable in diameter, as are the effusion holes and the dimensions of the surface structure.

While the impingement-cooling holes are essentially vertical to the impingement-cooling surface, the effusion holes are oriented to the hot-gas side surface at a shallow angle ranging between 10 and 45 degrees, and preferably between 15 and 30 degrees. The effusion holes can be purely axially oriented or form a circumferential angle. The effusion-hole pattern may be set in agreement with the surface structure.

In accordance with the present invention, a defined overflow of the ribs or the depressions, respectively, is provided to maximise the rib effect, while simultaneously minimising the disturbance of impingement cooling by the transverse flow. Shifting the exits of the effusion holes on the hot-gas side in the downstream direction safely avoids a pressure-gradient caused ingress of hot gas in the immediate vicinity of the burner. By optimising the overflow of the ribs/depressions and, if applicable, prisms, sufficient cooling effect is produced in this area.

With the ingress of hot gas being avoided and owing to the good cooling effect of the tile with improved impingement cooling, the tile temperature is reduced and, thus, the life of the component increased.

Figure 4:
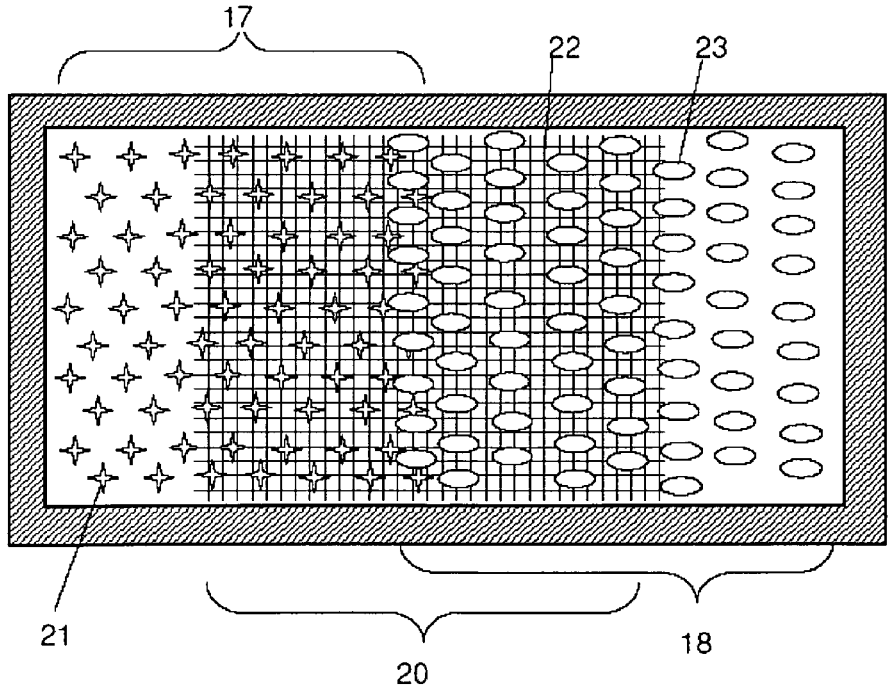
Figure 5:
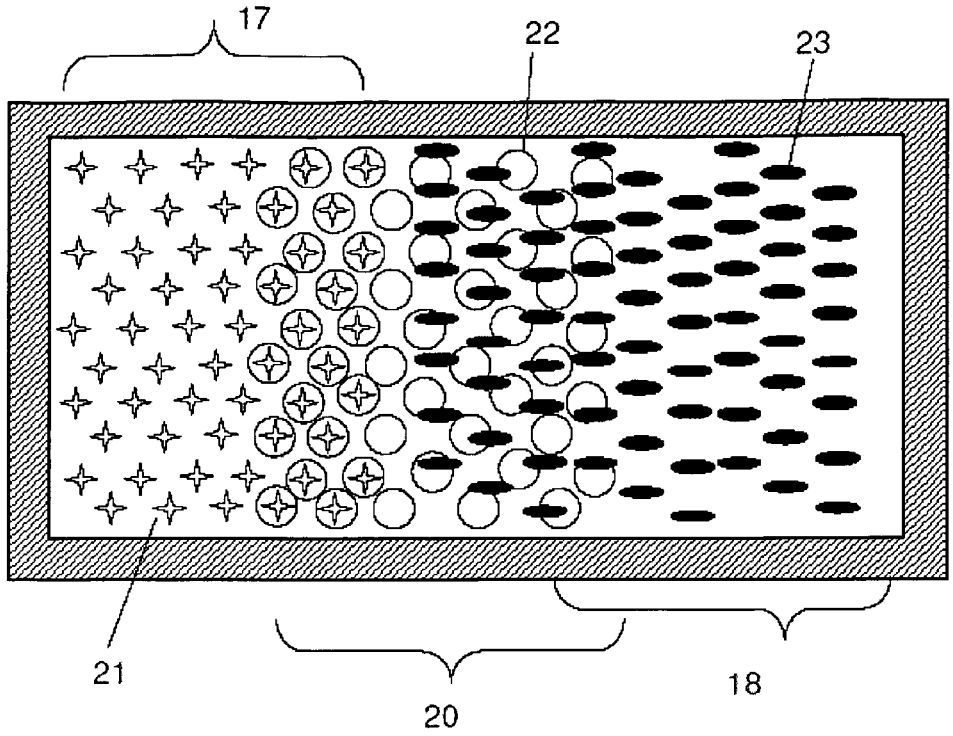
Figure 6:
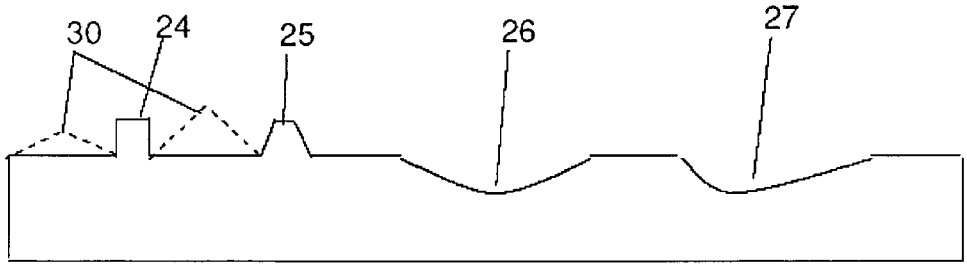
Figure 7:
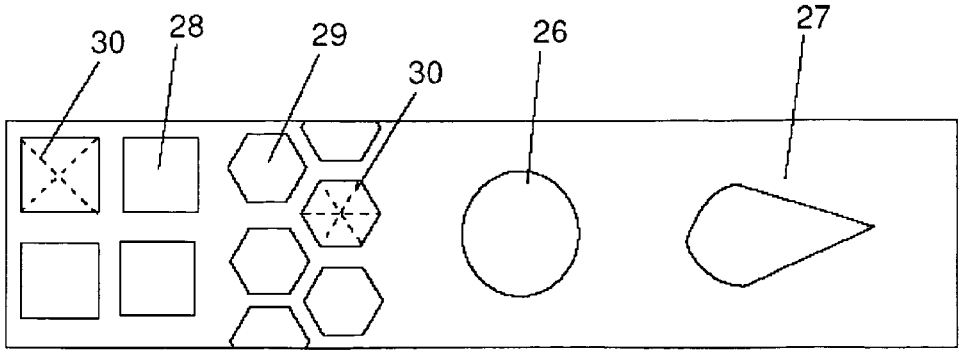

The present invention is more fully described in the light of the accompanying drawings showing preferred embodiments. In the drawings, FIG. 1 (Prior Art) is a schematic representation of a gas turbine with a gas-turbine combustion chamber, FIG. 2 (Prior Art) is a partial view of the axial section of an embodiment according to the prior art, FIG. 3 is a sectional view, analogically to FIG. 2, of an embodiment of the present invention, FIG. 4 is a schematic top view of the arrangement of an embodiment according to the present invention, FIG. 5 is a view, analogically to FIG. 4, of a further embodiment of the present invention, FIG. 6 is a simplified sectional view of an embodiment of the surface structure, and FIG. 7 is a simplified top view of a further variant of the surface structure, analogically to FIG. 6.

In the embodiments, like parts are identified by the same reference numerals.

FIG. 1 shows, in schematic representation, a cross-section of a gas-turbine combustion chamber according to the state of the art. Schematically shown here are compressor outlet vanes 1, a combustion chamber outer casing 2 and a combustion chamber inner casing 3. Reference numeral 4 designates a burner with arm and head, reference numeral 5 designates a combustion chamber head followed by a multi-skin combustion chamber wall 6 from which the flow is ducted to the turbine inlet vanes 7.

FIG. 2 shows an embodiment according to the state of the art, as known from Specification WO 92/16798 A, for example. Here, a combustion chamber wall 9 (tile carrier) is shown, which is provided with several inflow holes 8 (impingement-cooling holes) through which cooling air from the compressor exit air 12 is introduced into an interspace 14 between a tile 10 and the combustion chamber wall 9. The tile 10 is secured by means of studs 15 and attaching nuts 16. Furthermore, the tile comprises several effusion-cooling holes 11.

FIG. 3 shows a first embodiment of the combustion chamber wall according to the present invention. It comprises a surface structure 19 provided on the radially outward side of the tile 10 facing the combustion chamber wall 9, i.e. on the impingement surface of the tile 10. In FIG. 3, reference numeral 17 designates an area of impingement-cooling holes 8, while reference numeral 18 indicates an area of effusion-cooling holes 11. As becomes apparent from the illustration in FIG. 3, the areas 17 and 18 are offset in the axial direction (relative to the direction of flow of the compressor exit air 12 and the flame or the smoke gas 13, respectively).

FIG. 4 shows, in schematic top view, the offset of the area 17 of impingement cooling holes 8 and of the area 18 of effusion-cooling holes 11 or 23, respectively. As is apparent, the area of the surface structure 20 is arranged, with partial overlap, between the areas 17 and 18, with the individual elements of the surface structure being schematically indicated by reference numeral 22.

FIG. 5 shows, analogically to FIG. 4, a further modification with only partly overlapping areas (area 17 for the impingement-cooling holes 8, area 18 for the effusion-cooling holes 11 and area 20 for the surface structure 22). Reference numeral 21 schematically indicates an impingement-cooling hole 8 in the combustion chamber wall 9 (tile carrier) in projection on the tile 10.

FIG. 6 shows, in schematic side view (cross-section), various forms of the surface structure 19, 22. Here, a rib 24 with rectangular cross-section and a rib 25 with trapezoidal cross-section are provided as examples. Furthermore, the surface structure 19 may comprise circular depressions 26 as well as drop-like depressions 27 (see also FIG. 7). Reference numeral 30 schematically shows a prismatic protrusion (prism). The prism can be lower than the ribs 24, 25, higher than the ribs 24, 25, or have the same height as the ribs 24, 25.

FIG. 7 shows, analogically to FIG. 6, a schematic top view of a further variant illustrating rectangular cells 28 and hexagonal cells 29 which may also be provided with a prism 30.

LIST OF REFERENCE NUMERALS

1 Compressor outlet vanes
2 Combustion chamber outer casing
3 Combustion chamber inner casing
4 Burner with arm and head
5 Combustion chamber head
6 Multi-skin combustion chamber wall
7 Turbine inlet vanes
8 Inflow hole/impingement-cooling hole
9 Combustion chamber wall/tile carrier
10 Tile
11 Effusion-cooling holes
12 Compressor exit air
13 Flame and smoke gas
14 Interspace between tile 10 and combustion chamber wall 9
15 Stud
16 Attaching nut
17 Area of impingement-cooling holes 8
18 Area of effusion-cooling holes 11
19 Surface structure on impingement surface of tile 10
20 Area of the surface structure 19
21 Impingement-cooling hole in the tile carrier in projection on the tile
22 Individual element of the surface structure (rib, FIG. 4 or depression, FIG. 5)
23 Effusion-cooling hole
24 Rib with rectangular cross-section
25 Rib with trapezoidal cross-section
26 Circular depression
27 Drop-like depression (overflow essentially from the left-hand to the right-hand side)
28 Rectangular cells
29 Hexagonal cells
30 Prism (lower, higher than the rib or having the same height as the rib)

What is claimed is:

1. A gas-turbine combustion chamber wall for a gas-turbine comprising:

a combustion chamber wall;

a plurality of tiles arranged on an inner side of the combustion chamber wall, with an interspace being formed between the tiles and the combustion chamber wall;

impingement-cooling holes provided in the combustion chamber wall for introducing cooling air into the interspace;

effusion-cooling holes provided in the tiles through which cooling air from the interspace flows into a combustion chamber;

wherein the tiles include a surface structure on a side facing the combustion chamber wall;

wherein an area provided with the impingement-cooling holes, an area provided with the surface structure and an area provided with effusion-cooling holes are offset relative to each other in an axial direction of the combustion chamber such that there are four regions progressing in consecutive numeric order in the axial direction in a direction of combustion gas flow from first to fourth, each region having an axial extent and an inward/outward extent that encompasses both the combustion chamber wall and the inwardly arranged tiles along the axial extent, the four regions being a first region of only impingement cooling holes, a second region of overlap of impingement cooling holes and the surface structure, a third region of overlap of effusion cooling holes and the surface structure and a fourth region of only effusion cooling holes.

2. The gas-turbine combustion chamber wall of claim 1, wherein the offset is also provided in a circumferential direction.

3. The gas-turbine combustion chamber wall of claim 1, wherein the surface structure comprises at least one rib.

4. The gas-turbine combustion chamber wall of claim 1, wherein the surface structure comprises at least one depression.

5. The gas-turbine combustion chamber wall of claim 1, wherein the surface structure comprises at least one polygonal protrusion.

6. The gas-turbine combustion chamber wall of claim 1, wherein the surface structure comprises at least one prismatic protrusion.

7. The gas-turbine combustion chamber wall of claim 1, wherein the tile includes a thermal barrier coating of ceramic material.

8. The gas-turbine combustion chamber wall of claim 1, wherein the impingement-cooling holes are variable in diameter in at least one of an axial direction and a circumferential direction.

9. The gas-turbine combustion chamber wall of claim 1, wherein the effusion-cooling holes are variable in diameter in at least one of an axial direction and a circumferential direction.

10. The gas-turbine combustion chamber wall of claim 1, wherein dimensions of the surface structure are variable in size in at least one of an axial direction and a circumferential direction.

11. The gas-turbine combustion chamber wall of claim 1, wherein the impingement-cooling holes are essentially vertical to the combustion chamber wall.

12. The gas-turbine combustion chamber wall of claim 1, wherein the effusion-cooling holes are at a shallow angle of between 10 and 45 degrees.

13. The gas-turbine combustion chamber wall of claim 12, wherein the effusion-cooling holes are at an angle of between 15 and 30 degrees.

14. The gas-turbine combustion chamber wall of claim 1, wherein the effusion-cooling holes are oriented axially to the combustion chamber as regards their center axes.

15. The gas-turbine combustion chamber wall of claim 1, wherein the effusion-cooling holes are oriented at an angle to the axial axis of the combustion chamber, as regards the center axes of the effusion-cooling holes.

16. The gas-turbine combustion chamber wall of claim 1, wherein the second region and the third region overlap in the axial direction.

17. The gas-turbine combustion chamber wall of claim 1, wherein the second region and the third region do not overlap in the axial direction.

* * * * *